US007571996B2

(12) United States Patent
Domoto et al.

(10) Patent No.: US 7,571,996 B2
(45) **Date of Patent: *Aug. 11, 2009**

(54) APPARATUS FOR REDUCING PARTICULATE IN AN INK JET PRINTER

(75) Inventors: Gerald A. Domoto, Briarcliff Manor, NY (US); Elias Panides, Whitestone, NY (US); Mark Anthony Cellura, Webster, NY (US); Elliot Allan Eklund, Penfield, NY (US); Scott J. Phillips, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 499 days.

This patent is subject to a terminal disclaimer.

(21) Appl. No.: 11/502,283

(22) Filed: Aug. 10, 2006

(65) Prior Publication Data

US 2008/0036835 A1 Feb. 14, 2008

(51) Int. Cl.
*B41J 2/175* (2006.01)
*B41J 2/165* (2006.01)

(52) U.S. Cl. ..... 347/88; 347/29

(58) Field of Classification Search ..... 347/29, 347/84, 85, 88

See application file for complete search history.

(56) References Cited

U.S. PATENT DOCUMENTS 4,591,869 A 5/1986 Katerberg et al.
5,519,420 A 5/1996 Zorn et al.
6,068,364 A * 5/2000 Kusumi et al. ..... 347/29
6,890,053 B2 5/2005 Myhill et al.
2003/0016267 A1 1/2003 Green
2005/0099451 A1 5/2005 Kuester et al.
2005/0157119 A1 7/2005 Silverbrook

* cited by examiner

*Primary Examiner*—An H Do
(74) *Attorney, Agent, or Firm*—Maginot, Moore & Beck

(57) ABSTRACT

An apparatus in an ink jet printer reduces the risk of clogged nozzles in ink jet printing machines by providing a negative pressure area in the vicinity of a localized high shear stress region that is located about a print head perimeter. The apparatus includes a print head protector substantially surrounds a print head, the protector having a first substantially continuous slot along a portion of a length of the protector that is upstream of the print head and a second substantially continuous slot along a portion of a length of the protector that is upstream of the first substantially continuous slot, an inlet in fluid communication with the first substantially continuous slot, the inlet enables a positive pressure air supply to be coupled to the first substantially continuous slot so air entering the inlet flows through the first slot to displace debris from media approaching the print head, and an outlet in fluid communication with the second substantially continuous slot, the outlet enables a negative pressure source to be coupled to the second substantially continuous slot so displaced debris flows into the second substantially continuous slot and out through the outlet for removal from the ink printing machine in which the print head is located.

20 Claims, 5 Drawing Sheets

FIG. 7
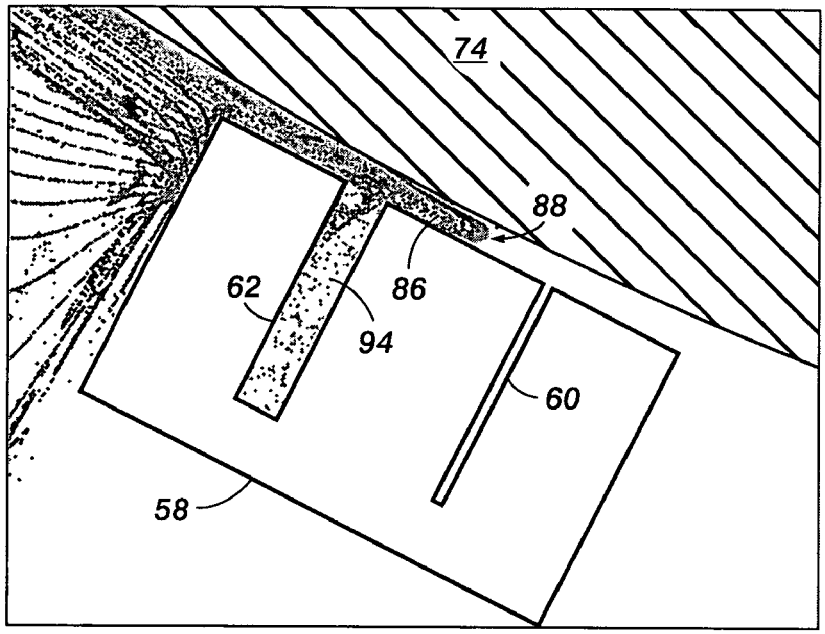
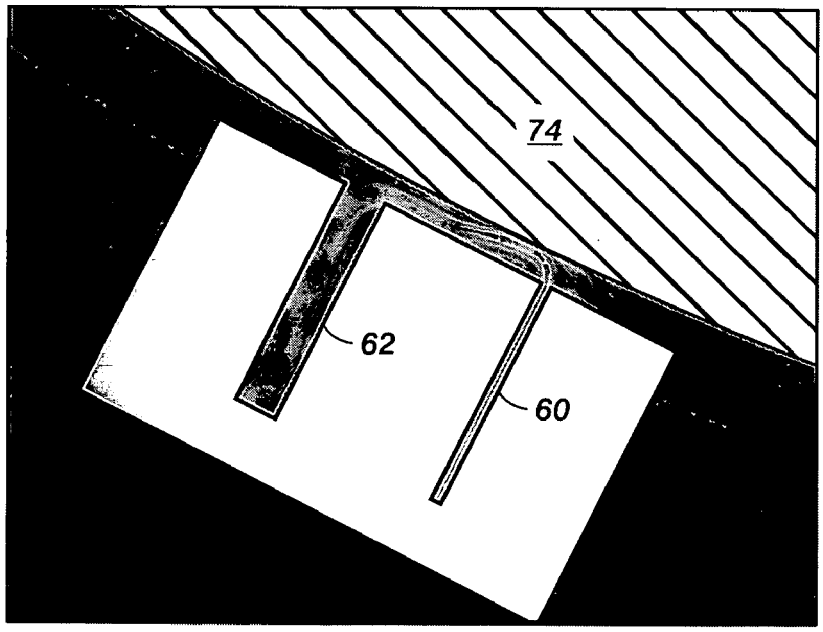
FIG. 8

APPARATUS FOR REDUCING PARTICULATE IN AN INK JET PRINTER

CROSS-REFERENCE

Cross-reference is made to co-pending U.S. patent application entitled "Apparatus For Reducing Ink Jet Contamination" having Ser. No. 11/318,284 that was filed on Dec. 23, 2005.

TECHNICAL FIELD

This disclosure relates generally to ink printers, and particularly to print heads used in ink printers.

BACKGROUND

Solid ink or phase change ink printers conventionally receive ink in a solid form, either as pellets or as ink sticks. The solid ink pellets or ink sticks are placed in a feed chute and a feed mechanism delivers the solid ink to a heater assembly. Solid ink sticks are either gravity fed or urged by a spring through the feed chute toward a heater plate in the heater assembly. The heater plate melts the solid ink impinging on the plate into a liquid that is delivered to a print head for jetting onto a recording medium. U.S. Pat. No. 5,734,402 for a Solid Ink Feed System, issued Mar. 31, 1998 to Rousseau et al.; and U.S. Pat. No. 5,861,903 for an Ink Feed System, issued Jan. 19, 1999 to Crawford et al. describe exemplary systems for delivering solid ink sticks into a phase change ink printer.

Once the ink is melted, it typically drips into an ink reservoir. The reservoir is coupled by conduits to a print head for jetting the liquid ink onto the recording medium. In color printers, a print head is provided for each composite color. For example, a color printer may have one print head for emitting black ink, another print head for emitting yellow ink, another print head for emitting cyan ink, and another print head for emitting magenta ink. Color images may be comprised of four images, one for each of the composite colors. The image data for each of the composite colors are provided to a print head controller for generation of a color image.

The print head controller uses the image data for a composite color to control the operation of the print head for the corresponding composite color. In some ink printers, the ink may be emitted by a print head directly onto a sheet of recording medium. In other printers called offset printers, the ink is emitted onto an intermediate revolving imaging drum. When an intermediate imaging drum is used, several revolutions of the imaging drum may occur before the complete image is generated. Once the image is generated, a transfer roller engages the imaging drum and a sheet of recording medium is fed into the nip between the imaging drum and the transfer roller. The pressure and heat in the nip transfer the inked image from the imaging drum onto the recording medium. The sheet bearing the image, in both direct and offset printing, is then transported to a discharge area.

The print head in an ink printer may be comprised of many piezoelectric ejectors that expel a small amount of ink when energized by a voltage signal. The ejectors are arranged in a print head in a row and column matrix. The voltage signals for the ejectors are selectively generated by the print head controller in correspondence with the pixilated image data. Thus, the print head controller causes the ejectors of the print head to emit droplets of ink that are deposited on a media sheet or an imaging drum as it passes the print head to form an image.

Recording media sheets, particularly paper, can produce fibers and other particulate matter as they move from the supply stack through the transfer nip to the discharge area. These particulates and fibers along with dust typically present in air may enter the gap between a print head and an imaging drum. Some of the fibers and particulate may clog nozzles of the ejectors in a print head. The risk of paper fibers and particulates clogging print head nozzles is especially present in direct printing machines because the media sheet is brought so close to the print head for printing. Clogged nozzles adversely impact the quality of the images generated by the printing machine.

A device for reducing the amount of paper fibers and particulates in the vicinity of an ink jet print head is disclosed in co-pending U.S. patent application entitled "Apparatus For Reducing Ink Jet Contamination" having Ser. No. 11/318,284 that was filed on Dec. 23, 2005. That application is assigned to the assignee of the subject matter disclosed herein and is hereby expressly incorporated by reference in its entirety. The apparatus disclosed in this application is useful for generating a barrier in the vicinity of an ink jet print head; however, the particulate removed from the paper approaching the print head is re-distributed to other locations in the printer. These particulates and fibers may accumulate over time and adversely impact environmental conditions for other printer components.

SUMMARY

An apparatus disclosed herein reduces the risk of clogged nozzles in ink jet printing machines by providing a negative pressure area in the vicinity of a localized high shear stress region that is located about a print head perimeter. The apparatus includes a print head protector that surrounds a print head, the print head protector includes a first substantially continuous slot that is provided along at least a portion of a length of the protector and a second substantially continuous slot that surrounds the first substantially continuous slot. The second substantially continuous slot is wider than the first substantially continuous slot. An inlet in fluid communication with the first substantially continuous slot enables a positive pressure air supply to be coupled to the inlet and an outlet in fluid communication with the second substantially continuous slot enables a negative air pressure source to be coupled to the outlet. The air entering the inlet flows through the first slot and flows outwardly away from the print head to produce a localized high shear stress region surrounding the print head that displaces fibers and particulates from paper approaching the print head. The displaced fibers and particulates are captured in the negative pressure near the second substantially continuous slot and transported through the outlet for expulsion from the printer. Thus, fibers and particulates are displaced from paper before the paper is printed by the print head and expelled from the printer by the negative air supply.

BRIEF DESCRIPTION OF THE DRAWINGS

FIG. 7 depicts a simulation of particulate movement arising from the air flow from the slot 60 to the slot 62 shown in FIG. 6.

FIG. 8 a simulation of contours for air velocity magnitudes for the air flowing from the high pressure slot to the negative pressure slot shown in FIG. 6.

DETAILED DESCRIPTION

Figure 1:
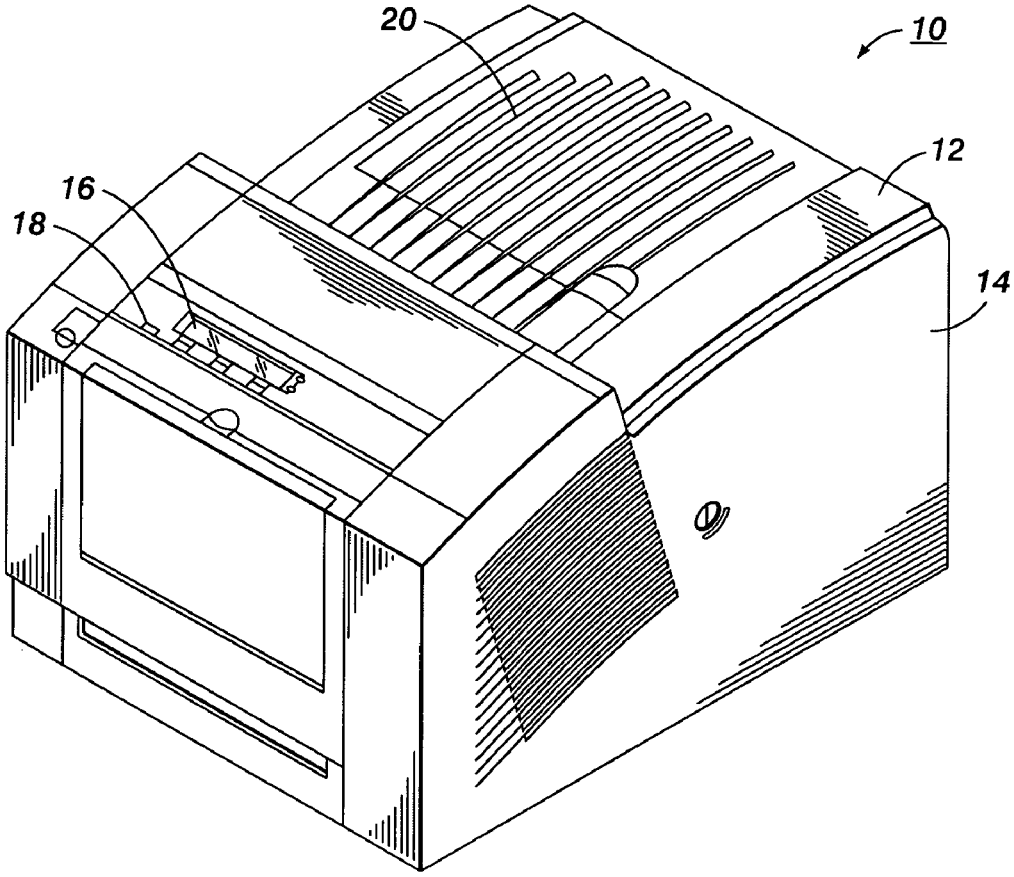
FIG. 1 is a perspective view of a phase change printer having an air barrier that removes media debris from the printer.

FIG. 1 shows a solid ink, or phase change, ink printer 10 in which a print head protector may be used to remove fibers and particulates from media approaching the print head and to expel the removed fibers and particulates from the printer. The printer 10 includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer.

An ink jet printing mechanism (not shown) is contained inside the housing. A printing mechanism for offset printing is described in U.S. Pat. No. 5,805,191, entitled Surface Application System, to Jones et al. A printing mechanism for direct printing of a recording media sheet is described in U.S. Pat. No. 5,455,604, entitled Ink Jet Printer Architecture and Method, to Adams et al. Both of these printing mechanisms include a rotating drum that is separated from the print head by a small gap. In the direct printing machine, the recording media sheet is fed into this gap so that ink may be ejected from the print head onto the recording media sheet. In the offset printing machine, the ink is ejected from the print head onto the imaging drum and subsequently transferred to a recording media sheet.

In both types of printing machines, the ink jet print head is typically mounted to a pair of rails and driven in a conventional manner by a motor transversely across the sheet of print media or the face of the imaging drum to scan the media or drum during the printing operation. The ink jet print head ejects ink toward the print media or the imaging drum while the sheet or drum is positioned in a print zone. This printing may continue as the print media is transported through the zone by the rotation of the drum supporting the media or as the imaging drum rotates past the print head.

The ink jet print heads used in both types of printing machines may use acoustic drivers, and more specifically piezoceramic materials, for generating a pressure wave in the ink jet print head in response to drive signals. These pressure waves cause the ejection of ink drops from associated nozzle orifices on demand. Resolutions of 300 dots/inch or more can be achieved using ink jet print heads of this type. Also, these ink jet print heads may be utilized for ejecting drops of hot-melt or phase-change ink toward print media, as well as for ejecting non-hot-melt ink, such as aqueous ink. In the case of hot-melt ink jet printers, heaters are included to heat the ink reservoir and ink jet print head to maintain the ink in a liquid state for jetting purposes. Ink drops or spots are thus applied to the print media or an imaging drum during printing.

A color printer typically uses four colors of ink (yellow, cyan, magenta, and black). Ink sticks 30 of each color are delivered through separate feed channels to a melt plate. Consequently, each channel has a melt plate, ink reservoir, and print head that is independent from the corresponding components for the other colors. The print heads may be located at different positions about the centrally located rotating drum.

In the direct printing machines, the print media sheets, particularly paper, may carry particulates and fibers into the printing zone opposite the print head. These particulates and fibers may dislodge from the sheet and migrate towards the nozzle orifices in the print head. Some of this debris may become lodged in the orifices, either temporarily or permanently. The clogged nozzles degrade the quality of the images printed on the media sheets.

Even in offset printing machines, the risk of clogged nozzle orifices from floating debris remains. The sheet supply in offset printing machines may be fluffed to assist removal of the top sheet from the sheet supply. This fluffing may release or loosen fibers and particulates that become suspended in the air at the supply. This air may then be carried by currents within the machine to the printing zone. Also, the sheets are brought to a position proximate to the imaging drum for transfer of the image from the imaging drum to the sheet media. The movement may also dislodge fibers and particulates into the print head environment that may later clog nozzle orifices.

Figure 2:
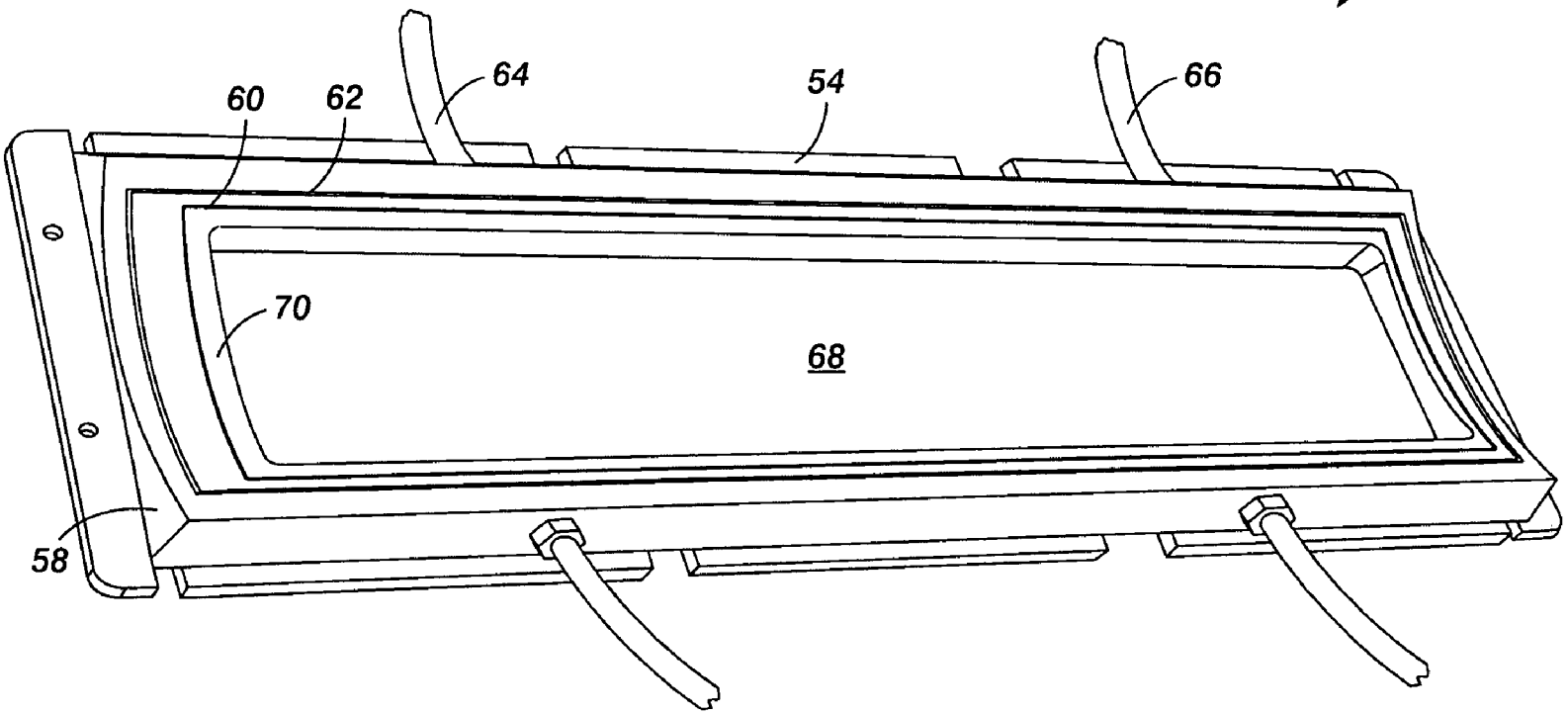
FIG. 2 is a perspective view of one embodiment of the print head protector displaying the two substantially continuous slots used for air flow near the print head.

The print head protector shown in FIG. 2 may be installed in direct printers and offset printers to reduce the risk of clogged nozzle orifices from debris in the vicinity of the print head. The print head protector 50 includes a plate 54 and a barrier wall 58 extending upwardly from the plate. The wall 58 has a narrow substantially continuous slot 60 and a wide substantially continuous slot formed therein. The narrow slot 60 in the wall 58 is in fluid communication with one or more inlets 64 in wall 58 and the wide slot 62 is in fluid communication with one or more outlets 66 in wall 58. The inlets 64 enable a positive pressure air supply (not shown) to be coupled to the protector 50 so that air may be emitted from the slot 60. The positive air flow emitted from the slot 60 removes particulate and fibers from media approaching the print head surrounded by the protector 50. The outlets 66 enable a negative pressure source (not shown) to be coupled to the protector 50 so that air may be emitted from the slot 62. The negative air flow into the slot 62 captures a substantial portion of the particulate and fibers displaced by the positive air flow. The negative air flow is expelled from the printer to remove the debris from the environment for the internal components of the printer.

The slot 60 may be continuously formed around the perimeter or it may be an intermittent slotted structure. Although shown as being straight walled, the slot 60 may be a plurality of cylindrical, elliptical, or other non-linear shaped openings. Likewise, the slot 62 may be continuously formed around the perimeter or it may be an intermittent slotted structure. Although shown as being straight walled, the slot 62 may be a plurality of cylindrical, elliptical, or other non-linear shaped openings. A recess 68 is housed within the wall 58. When a positive pressure air supply is coupled to the protector 50 so air is emitted from the slot 60, the pressure within the recess 68 is greater than the ambient pressure outside the protector 50. Thus, the recess 68 acts as a plenum when a positive pressure air supply is coupled to the protector 50. That is, the positive pressure source generates a quiescent area of static pressure within the recess that is greater than static pressure outside the quiescent pressure area within the recess 68 and its periphery. This quiescent higher pressure reduces the risk of particulates and fibers entering the space proximate the print head without causing significant air currents in that space that may adversely impact the ejection of ink drops from the print head onto an imaging drum or media sheet.

If a plurality of inlets 64 is provided, one of the inlets may be used to house a pressure transducer to monitor the pressure within the recess of the protector 50. The slot 60 may also include a filter so that the air emitted from the slot is relatively clean and free of debris. The filter openings are sized to remove the smallest particulates of interest for the print head environment. In one embodiment, the filter is structured to remove particulates of 10 microns in diameter or larger. Of course, the filter may be placed in the air stream of the positive pressure air supply before it reaches an inlet in the wall 58.

Coupling a negative pressure source to an outlet 66 lowers the air pressure at the edge of the static pressure region in the recess. Because the slot 62 is incorporated within the protector 50, the negative air pressure pulls air from the gap between the protector 50 and the drum 74 rather than from the ambient environment surrounding the protector 50. Consequently, the air containing the debris removed from media approaching the print head is pulled into the wide slot 62 so it is transported through an outlet 66. The air containing the debris may be directly expelled from the printer or it may be filtered into a collection bag for occasional removal from the printer.

The print head protector shown in FIG. 2 may be milled from stainless steel or aluminum or the like. In another embodiment, the protector may be formed from composite lightweight material, such as graphite composites. The plate may be formed with apertures for receiving fasteners so the protector may be mounted to a bracket or other supporting structure proximate to a print head. In printing machines having more than one print head, the protector may be made large enough to encompass all of the print heads in a single protector or each print head may be provided with a print head protector.

Figure 3:
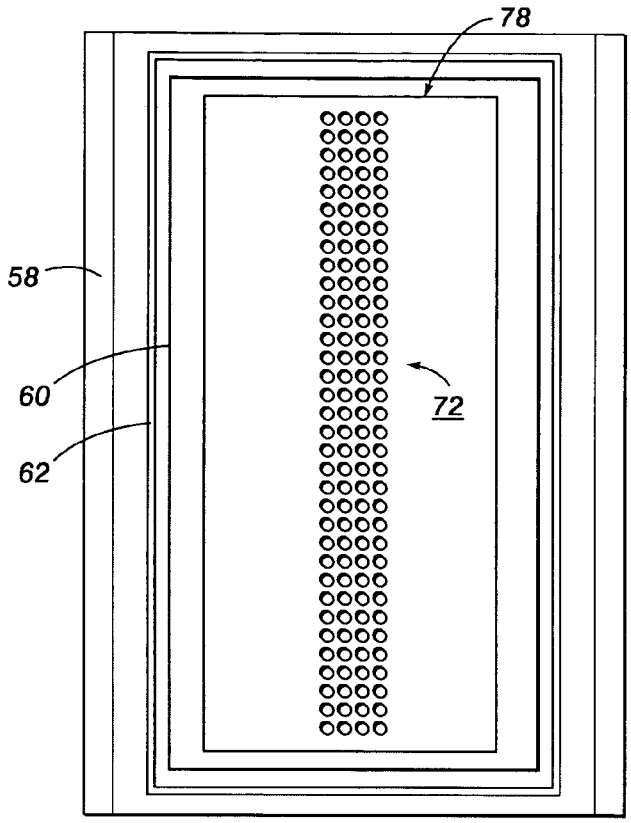
FIG. 3 is a schematic diagram of the print head protector embodiment shown in FIG. 2.

As shown in FIG. 3, the print head protector 50 is mounted about a print head 78 so that the nozzles 72 of the print head are within the recess 68. The slot 60 is shown as extending continuously around the perimeter of the protector 50 and the slot 62 is shown as extending continuously around the perimeter to surround the slot 60. As air is emitted at the slot 60, the recess 68 reaches a higher pressure than the ambient air outside the protector 50. When a filter is used to clean the air flowing out of the slot 60, the air in the immediate vicinity of the print head has fewer particulates and fibers in it than the ambient air. The positive pressure helps keep the relatively dirty air outside the protector from entering the immediate environment of the print head.

After the negative pressure source is activated, air at the edge of the positive pressure region begins to flow into the slot 62. This air flow enables the relatively dirty air to be swept from the protector 50 towards the negative pressure source. Near the negative pressure source, the dirty air is expelled or filtered for collection of the particulate and fibers.

In an effort to preserve the positive pressure in the protector 50, embodiments of the protector that are mounted in proximity to rotating drums are curved at the outboard ends 70 of the wall 58 as shown in FIG. 2. The curve of these ends corresponds to the radius of curvature for the rotating drum opposite the print head surrounded by the protector 50. By curving these ends, a uniform gap between the slots 60 and 62 in the wall 58 and the rotating drum is maintained. The size of this gap is important for maintaining the pressure differential between the protector 50 and the ambient air. This gap should be comparable to the gap between the ink jet nozzles and the rotating drum. In one embodiment, the gap is the same as the ink jet nozzle/rotating drum gap, which is 0.508 mm.

Figure 4:
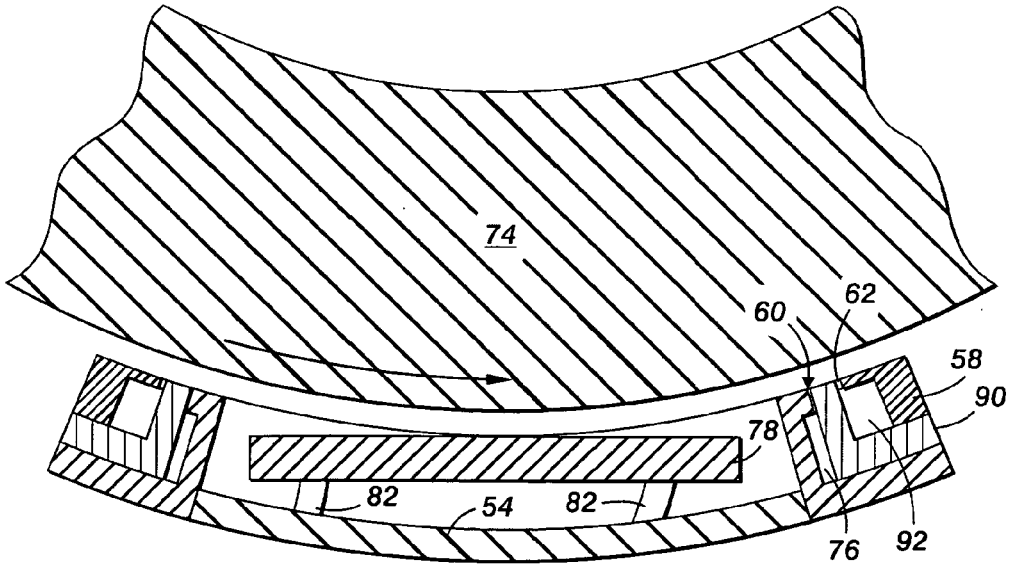
FIG. 4 is a cross-sectional view of an embodiment of the print head protector shown in FIG. 3 and its relationship with the rotating drum and the print head.

A cross-sectional view of one embodiment of the print head protector is shown in FIG. 4. The protector 50 includes three components, the plate 54, a separator 90, and the wall 58. The plate 54 and separator 90 are formed so they come within approximately 200 microns of one another at slot 60. Behind slot 60, wall 58 and plate 54 are configured to form a manifold space 76 between them. The manifold space 76 is in fluid communication with an inlet 64 and the slot 60. The air from the positive pressure air supply generates a pressure in the manifold space 76 that stabilizes the pressure within the protector 50 even though a pressure differential occurs at the slot 60 as the air is emitted through the slot.

The wall 58 and the separator 90 are formed so they come within approximately 800 microns of one another at slot 62. Behind slot 62, the wall 58 and the separator 90 are configured to form a manifold space 92 between them. The manifold space 92 is in fluid communication with an outlet 66 and the slot 62. The negative pressure air supply generates a pressure in the manifold space 92 that stabilizes the pressure within the protector 50 even though a pressure differential occurs at the slots 60 and 62 as air moves from one slot to the other.

The recessed area of the plate 54 surrounds the print head 78 so a positive static pressure may be established in the vicinity of the print head. The plate 54 and the wall 58 may be configured so that slots 60 and 62 exist only on the upstream side of the print head 78, which is the left side of FIG. 4 as the drum 74 rotates in the counterclockwise direction. In this embodiment, the plate 54, the separator 90, and the wall 58 may be configured to provide the manifold spaces 76 and 92 only on the upstream side as well, depending upon the volume required to stabilize the pressure in protector 50. This embodiment sufficiently removes debris from the drum or media sheet that the risk of nozzle clogging is substantially reduced. To ensure that the plenum in such embodiments remains at a pressure greater than the one outside the protector, the uniformity of the gap between the protector 50 and the rotating drum 74 may require more precision. As shown in FIG. 4, the print head 78 is supported on the plate 54 by a plurality of pads 82.

In one embodiment of a protector having a positive air flow slot 60 and a negative air flow slot 62, the positive air flow slot 60 is 200 microns wide and 4 millimeters long. The negative air flow slot 62 is 800 microns wide and 4 millimeters long. The depth of the slots 60 and 62 is 12 inches. The distance between the slot 60 and the slot 62 is 2.8 millimeters. The inlet(s) 64 are coupled to a positive air flow supply that produces air flow at approximately 630 Pa or approximately 2.5 inches. The positive pressure may be reduced by reducing the length of the slot as long as the slot length is at least 5-10 times the width of the slot. The outlet(s) are coupled to a negative pressure source that pulls air with a pressure of approximately 40 Pa or approximately 0.16 inches. The negative air pressure is less because the width of the slot 62 is approximately four times (4×) greater than the width of the high pressure slot 60. The protector 50 was mounted proximate to a rotating drum so that the ink jet/drum gap and the slot/drum gap was approximately 0.508 mm. The 4.5 inch diameter drum rotated at an angular speed of 21.1 rads/seconds in the counterclockwise direction. These source pressures and protector geometries provide an air flow rate through the slot 60 of approximately 20 meters/second or 2.6 cubic feet per minute (cfm) and an air flow rate through the slot 62 of approximately 5 meters/second or 2.6 (cfm). The balance of the flow rates between the high pressure and low pressure sides help maintain a positive pressure in the protector.

Figure 5:
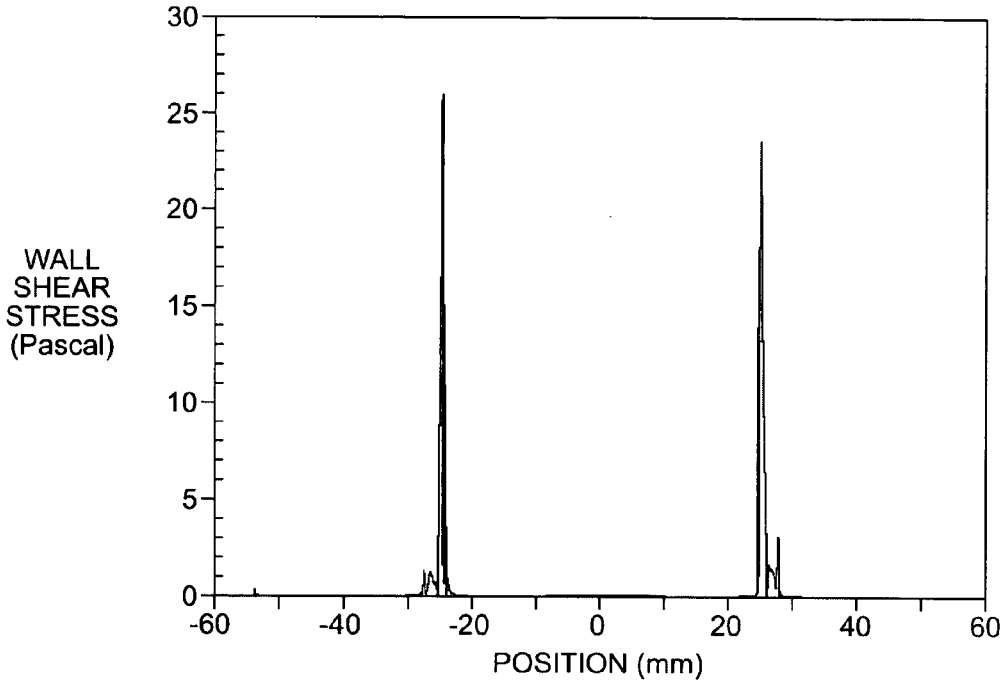
FIG. 5 is a graph depicting shear stress distribution on the surface of the rotating drum generated by the air flow from the slots in the print head protector shown in FIG. 4.

The graph shown in FIG. 5 demonstrates the shear stress generated by the air flow at the slot 60. The stress, measured in pascals, is shown at distances relative to the center of the plenum. As shown in the figure, the shear stress is the greatest at the upstream slot position. The next greatest shear occurs at the downstream slot position. The shear at the upstream position helps ensure that fibers and particulates are dislodged from a media sheet or drum surface before they enter the plenum, while also preventing those particulates and fibers from entering the recess in the protector 50. The shear at the downstream side helps prevent the ingress of particulate and fibers that may be present in the ambient air.

Figure 6:
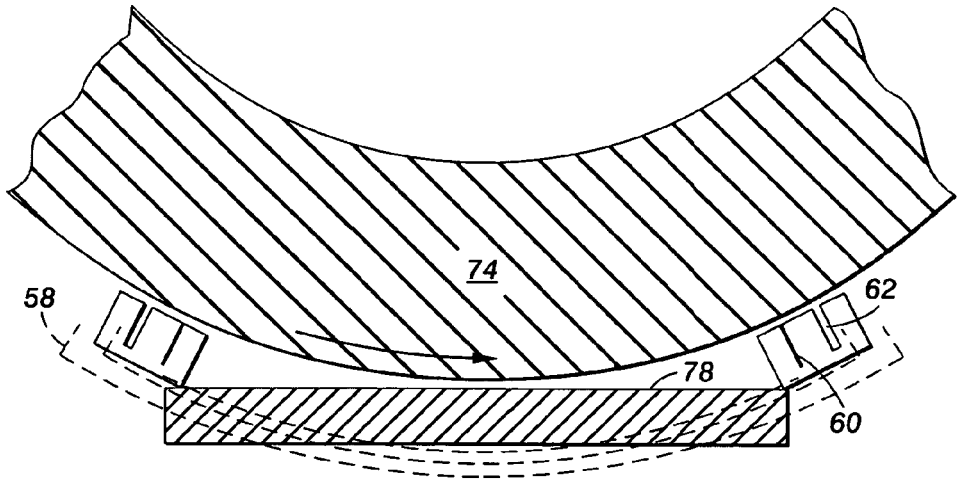
FIG. 6 depicts the relationship of the slots in the print head protector to a sheet of paper on the rotating drum and the print head.

FIG. 6 shows the relationship of the slots 60 and 62 to a sheet of paper 76 on the rotating drum 74 and the print head 78. In the figure, air is emitted from the slot 60 in the wall 58 so it impinges on the drum 74. The resulting curtain of air removes particulates entering the gap between the protector 50 and the drum 74 as depicted in FIG. 7. The particulates 86 on a media sheet are removed from the sheet by the air flowing from the slot 60. The particulate removal occurs downstream of the slot 60 at a position 88. A portion of these particulates are expelled from the protector 50, while another portion is pulled into the reduced pressure area 94 in the gap 62. These particulates may be collected or exhausted from the printer.

The pressure in the area 94 may be decreased by increasing the negative air flow rate by coupling a negative pressure source to the gap 62. This reduction in pressure also reduces the static pressure in the area of the print nozzle. This reduction in pressure in the printing area is thought to improve ink drop jetting. For example, if the negative flow rate is doubled to an average air speed of 10 m/s or flow rate of 5.2 cfm, the pressure in the printing nozzle area is reduced to a range of about 5 Pa to about 10 Pa. Additionally, the increased negative flow rate draws in a considerable volume of ambient air and the particulates carried by that air. The air velocity magnitude contours, as depicted in FIG. 8, reveal that the velocity magnitude of the air exiting the slot 60 is tightly consistent to expel particulates. This velocity band widens as it enters the slot 62 and slows as it moves through the wider slot towards its exit point.

Maintaining pressure within the protector is affected by the angle of the slot to the drum surface. In the figures presented herewith, the slot is practically normal to the drum surface. In embodiments where lower pressures are appropriate for the geometries and dimensions discussed above, the slots may be formed in the wall of the protector so they angle outwardly from the protector. For embodiments where higher pressures are appropriate within these parameters, the slots may be angled inwardly towards the protector.

Those skilled in the art will recognize that numerous modifications can be made to the specific implementations described above. For example, the print head protector disclosed herein may be adapted for web printing processes and machines. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for use with a print head in an ink printing machine, the apparatus includes:

a print head protector having a plate and a wall extending from the plate to form a recess in which a print head is located, the protector having a first substantially continuous slot formed in the wall and a second substantially continuous slot formed in the wall and being displaced from the first substantially continuous slot;

an inlet in fluid communication with the first substantially continuous slot, the inlet enables a positive pressure air supply to be coupled to the first substantially continuous slot to enable air entering the inlet to flow through the first substantially continuous slot to displace debris from media approaching the print head located in the recess of the print head protector; and an outlet in fluid communication with the second substantially continuous slot, the outlet enables a negative pressure source to be coupled to the second substantially continuous slot to enable the displaced debris to flow into the second substantially continuous slot and out through the outlet for removal from the ink printing machine in which the print head is located.

2. The apparatus of claim 1 wherein the wall and the first and the second substantially continuous slots extend around a perimeter of the print head protector.

3. The apparatus of claim 2 wherein the second substantially continuous slot has a width of approximately 800 microns.

4. The apparatus of claim 2 wherein positive air flow through the first substantially continuous slot and negative pressure through the second substantially continuous slot are independently adjustable.

5. The apparatus of claim 4 wherein the positive air flow rate through the first substantially continuous slot is less than the negative air flow rate through the second substantially continuous slot.

6. The apparatus of claim 4 wherein the positive air flow rate through the first substantially continuous slot is approximately one-half the negative air flow rate through the second substantially continuous slot.

7. The apparatus of claim 4 wherein the positive air flow rate through the first substantially continuous slot is approximately equal to the negative air flow rate through the second substantially continuous slot.

8. The apparatus of claim 7 wherein the air flow rate through the first and the second substantially continuous slots flows at a rate of approximately 2.6 cubic feet per minute.

9. The apparatus of claim 1 wherein the first substantially continuous slot and the second substantially continuous slot are separated by a distance of about 2.8 millimeters.

10. An ink printing machine having an apparatus associated with a print head, the ink printing machine including:

a rotating drum;

a print head located proximate the rotating drum, the print head having a plurality of ink jets for ejecting ink to form an image;

a print head protector having a plate and a wall extending from the plate to form a recess in which the print head is located, the protector having a first substantially continuous slot formed in the wall and a second substantially continuous slot formed in the wall and displaced from the first substantially continuous slot;

an inlet in fluid communication with the first substantially continuous slot, the inlet enables a positive pressure air supply to be coupled to the first substantially continuous slot to enable air entering the inlet to flow through the first substantially continuous slot to displace debris from media approaching the print head located in the recess of the print head protector; and an outlet in fluid communication with the second substantially continuous slot, the outlet enables a negative pressure source to be coupled to the second substantially continuous slot to enable the displaced debris to flow into the second substantially continuous slot and out through the outlet for removal from the ink printing machine in which the print head is located.

11. The ink printing machine of claim 10 wherein the wall and the first and the second substantially continuous slots extend around a perimeter of the print head protector.

12. The ink printing machine of claim 11 wherein the substantially continuous slot has a width of approximately 800 microns.

13. The ink printing machine of claim 11 wherein positive air flow through the first substantially continuous slot and negative pressure through the second substantially continuous slot are independently adjustable.

14. The ink printing machine of claim 13 wherein the positive airflow rate through the first substantially continuous slot is less than the negative air flow rate through the second substantially continuous slot.

15. The ink printing machine of claim 13 wherein the positive airflow rate through the first substantially continuous slot is approximately one-half the negative air flow rate through the second substantially continuous slot.

16. The ink printing machine of claim 13 wherein the positive airflow rate through the first substantially continuous slot is approximately equal to the negative air flow rate through the second substantially continuous slot.

17. The ink printing machine of claim 16 wherein the air flow rate through the first and the second substantially continuous slots flows at a rate of approximately 2.6 cubic feet per minute.

18. The ink printing machine of claim 10 wherein the first substantially continuous slot and the second substantially continuous slot are separated by a distance of about 2.8 millimeters.

19. The ink printing machine of claim 10 wherein the rotating drum is an intermediate imaging drum.

20. The ink printing machine of claim 10 wherein the rotating drum is a transport drum for passing a media sheet before the print head for direct printing on the media sheet.

* * * * *